United States Patent [19]

Jost et al.

[11] Patent Number: 4,626,329

[45] Date of Patent: Dec. 2, 1986

[54] CORROSION PROTECTION WITH SACRIFICIAL ANODES

[75] Inventors: John W. Jost, Santa Ana; Mohammad H. Ghandehari, Brea, both of Calif.

[73] Assignee: Union Oil Company of California, Los Angeles, Calif.

[21] Appl. No.: 693,279

[22] Filed: Jan. 22, 1985

[51] Int. Cl.[4] ..... C23F 13/00; C22C 21/00

[52] U.S. Cl. ..... 204/148; 420/528; 420/540

[58] Field of Search ..... 420/528, 540; 204/148, 204/197

[56] References Cited

U.S. PATENT DOCUMENTS 3,383,297 5/1968 Eberius ..... 204/148
4,141,725 2/1979 Murai et al. ..... 420/541
4,213,799 7/1980 Raghavan et al. ..... 420/537
4,213,800 7/1980 Mayo et al. ..... 420/537

FOREIGN PATENT DOCUMENTS 281822 12/1970 U.S.S.R. ..... 420/540

*Primary Examiner*—L. Dewayne Rutledge
*Assistant Examiner*—Robert L. McDowell
*Attorney, Agent, or Firm*—Dean Sandford; Gregory F. Wirzbicki; Robert A. Franks

[57] ABSTRACT

A method for inhibiting corrosion of metal in an electrolytic environment comprises electrically interconnecting the metal with an anode consisting essentially of an alloy of aluminum with a rare earth metal or mixture of rare earth metals, optionally also including zinc, and placing the anode into the environment.

13 Claims, No Drawings

CORROSION PROTECTION WITH SACRIFICIAL ANODES

BACKGROUND OF THE INVENTION

1. Field of the Invention

This invention relates to the protection of metallic equipment against corrosion, and more particularly to methods for protection using sacrificial anodes.

2. Description of the Art

Cathodic protection systems are employed to prevent corrosion of metal structures exposed to an electrolytic environment. Cathodic protection can be effected for marine or subterranean corrodible structures by electrically connecting the corrodible structure to sacrificial anodes constructed of a metal that is higher in the electromotive series than the protected structure, i.e., a metal that is anodic to the material of the protected structure. When the protected structure and the electrically connected sacrificial anode are both disposed within the same electrolytic environment (e.g., soil or water containing ions), a galvanic cell is formed in which the protected structure is the cathode.

Metal atoms on the exposed surface of the sacrificial anode are ionized by the surrounding electrolyte and go into solution with the electrolyte, thereby corroding the sacrificial anode. Due to the difference in electrical potential between the cathodically protected metal and the sacrificial anode, electrons produced by the electrochemical corrosion reaction of the anode flow as an electrical current through the electrical connection between the sacrificial anode and the protected structure. When electrons reach the protected structure, they combine with positive ions (such as hydrogen ions) or dissolved oxygen in the electrolyte at the surface of the protected structure. The protected structure does not corrode since the positive ions or oxygen would otherwise initiate a corrosion reaction at the surface of the protected structure.

For protecting structures made from ferrous metals such as iron and steels, the sacrificial anodes are generally magnesium, aluminum, or zinc. Aluminum is a preferred material for this service, due to its relatively low price, low density, and high theoretical electrical capacity (due to formation of a trivalent cation). However, since pure aluminum quickly passivates during galvanic operation, because a layer of oxide material forms on the anode surface, it has been found necessary to utilize various alloys of aluminum.

A study of electrochemical efficiency, as a function of composition, for various aluminum alloy galvanic anodes in sea water was given by T. J. Lennox, Jr., M. H. Peterson, and R. E. Groover, *Materials Protection*, Vol. 33, February 1968, pages 33 through 37. This paper relates the former popularity of 5 percent zinc-aluminum alloys, and the test results of various zinc-aluminum alloys which contain other metals, selected from tin, mercury, boron, and iron.

U.S. Pat. No. 4,141,725 to Murai et al. describes galvanic anodes, which are aluminum alloys also containing zinc, indium, calcium, magnesium, and at least one rare earth element. Ranges of metal concentrations said in the patent to be useful can be described as:

$$10\% > Zn > 0.5\%$$

$$0.05\% > In > 0.005\%$$

$$0.5\% > Ca > 0.005\%$$

$$4\% > Mg > 0.1\%$$

$$0.05\% > RE > 0.001\%$$

wherein "RE" represents one or more rare earth metals and all percentages are expressed on a weight basis. The anodes are said to be useful for protecting steel structures in sea water.

Eberius, in U.S. Pat. No. 3,383,297, describes an anode for cathodic protection, which is an alloy of zinc with at least 0.02 weight percent rare earth metal. The rare earth can be lanthanum, lanthanum with up to 50 weight percent cerium, or misch metal containing at least 35 weight percent lanthanum. It is reported in the patent that adding the rare earth reduces polarization inactivation, corrosion, and coating of the zinc anodes.

Aluminum was alloyed with cerium or misch metal by Sarbey in U.S. Pat. No 3,373,779 and used for wire in flash lamps; the alloy was more easily ignited than was pure aluminum. Knapp et al., in U.S. Pat. No. 2,980,529, alloyed rare earth metals with aluminum, for avoidance of alumina formation when the aluminum is added to molten steel. The electrical conductivity of relatively impure aluminum for transmission line wire was improved by the addition of misch metal in U.S. Pat. No. 4,213,799 to Raghavan et al., and by the addition of yttrium in U.S. Pat. No. 4,213,800 to Mayo et al.

SUMMARY OF THE INVENTION

The invention is directed to a method for protecting metals, particularly ferrous metals, from corrosion in electrolytic environments, such as soils or aqueous solutions. This method comprises electrically interconnecting the metal to be protected with an anode consisting essentially of aluminum, alloyed with up to about 10 weight percent rare earth metal, or a mixture of rare earth metals, optionally also alloyed with up to about 5 weight percent zinc, and immersing the anode in the electrolyte with the metal. Dissolution of the anode establishes a flow of electric current, protecting the otherwise corrodible metal against undesired reactions with components of its environment.

DESCRIPTION OF THE INVENTION

For purposes of the invention, the term "rare earth" includes elements of the lanthanide series of the periodic table, plus the elements yttrium and scandium which have similar chemical properties, including elements having atomic numbers 21, 39, and 57 through 71. "Misch metal" is a mixture of rare earth elements, primarily elements of the lanthanide series which have atomic numbers 57 through 60; such mixtures are readily available commercially. The term "percent," when used herein to describe chemical compositions, means weight percent.

The present invention is a method for protecting metallic equipment against corrosion, using sacrificial galvanic anodes consisting essentially of aluminum, alloyed with up to about 10 percent rare earth metal, or a mixture of rare earth metals, optionally also alloyed with up to about 5 percent zinc. Preferred alloys contain at least about 0.01 percent rare earth metals, while more highly preferred alloys contain at least about 0.05 percent rare earth metals. When zinc is used, it is preferred to have at least about 0.1 percent zinc present in the alloy.

Pure aluminum normally is not useful for galvanic anodes, due to the rapid formation of an oxide coating on the anode, which stops galvanic action. However, alloying the aluminum with rare earth metal prevents oxide layer formation during anode operation. When zinc is added to the alloy, smaller amounts of rare earth metal are needed.

Alloys useful in the present invention are prepared by methods well known in the art, such as melting a quantity of aluminum, preferably having a purity at least about 99 percent, adding the desired quantity of alloying metal or metals, and mixing to promote formation of a homogeneous melt. Anodes can be formed in desired shapes from the molten alloy by casting, cladding, and other techniques known in the art. Further working or heat treatment of the anode shape can be performed to optimize electrical properties, by changing crystallinity, grain sizes, and the like.

For galvanic corrosion protection of a structure, one or more anodes, and the structure, are immersed in an electrolyte (soil or a solution) and are electrically interconnected. Techniques for assembling a suitable system are known in the art and can be utilized in the present invention.

The invention is further illustrated by the following examples, which are illustrative of various aspects of the invention and are not intended as limiting the scope of the invention, as defined in the appended claims.

EXAMPLE 1

Anodes are fabricated by melting aluminum and desired alloy metals in alumina containers, using an induction furnace and an argon atmosphere. After cooling the alloys, the containers are broken away from their contained metal and the metal is polished by a steel wire brush, or machined to remove adhering container material.

The finished anodes are electrically connected to sheets of mild steel, then the connected metals are immersed in aerated, synthetic sea water. Current flow through the electrical connection is measured for a period of over two weeks. Since the steel is much larger than the anode, the test is conducted at the maximum current which anodes are capable of supplying.

Misch metal ("MM") used for the anodes has the approximate composition:

| Element | Percent |
|---|---|
| Cerium | 50 |
| Lanthanum | 25 |
| Neodymium | 18 |
| Praseodymium | 6 |
| Samarium | 1 |

Results are summarized in Table I, where capacity of an anode is expressed in units of ampere-hours per pound of anode. These results show that rare earth additions greatly increase the suitability of aluminum for galvanic anode service.

TABLE I

| Anode Composition | | | Anode |
|---|---|---|---|
| Al Purity, % | % Zn | % MM | Capacity |
| 99.5 | — | — | 382 |
| 99.5 | — | 10 | 707 |
| 99.99 | — | — | 83 |
| 99.99 | — | 10 | 814 |

TABLE I-continued

| Anode Composition | | | Anode |
|---|---|---|---|
| Al Purity, % | % Zn | % MM | Capacity |
| 99.99 | 1.9 | 0.1 | 945 |

EXAMPLE 2

Anodes are fabricated as in the preceding example, except that the metals are melted in graphite and molten alloy is poured into a steel mold, producing anodes having a size similar to those prepared in the alumina containers.

The anodes are tested, as in Example 1. An anode containing 99.99 percent pure aluminum, alloyed with 1.9 percent zinc, quickly passivates due to formation of an oxide layer on the metal surface. However, a similar anode which also contains 0.1% misch metal has a capacity about 1,080 ampere-hours per pound.

Various embodiments and modifications of this invention have been described in the foregoing description and examples, and further modifications will be apparent to those skilled in the art. Such modifications are included within the scope of the invention as defined by the following claims.

What is claimed is:

1. A method for inhibiting corrosion of a metal structure in an electrolytic environment comprising electrically interconnecting the structure with an anode consisting essentially of aluminum, alloyed with about 0.01 to about 10 percent by weight of a rare earth metal or mixture of rare earth metals and placing the anode into the environment,

2. The method defined in claim 1 wherein the metal structure is fabricated using ferrous metal.

3. The method defined in claim 1 wherein the electrolytic environment is an aqueous solution.

4. The method defined in claim 3 wherein the solution is sea water.

5. The method defined in claim 1 wherein aluminum used to form the alloy has a purity at least about 99 percent by weight.

6. The method defined in claim 1 wherein the alloy contains misch metal.

7. As method for inhibiting corrosion of a metal structure in an electrolytic environment, comprising electrically interconnecting the structure with an anode consisting essentially of aluminum alloyed with up to about 5 percent by weight of zinc and about 0.01 to about 10 percent by weight of either a rare earth metal or a mixture of rare earth metals, and placing the anode into the environment.

8. The method defined in claim 7 wherein the metal structure is fabricated using ferrous metal.

9. The method defined in claim 7 wherein the electrolytic environment is an aqueous solution.

10. The method defined in claim 9 wherein the solution is sea water.

11. The method defined in claim 7 wherein aluminum used to from the alloy has a purity at least about 99 percent by weight.

12. The method defined in claim 7 wherein the alloy contains misch metal.

13. A method for inhibiting corrosion of ferrous metal in an aqueous solution, comprising electrically interconnecting the ferrous metal with an anode consisting essentially of up to about 5 percent by weight zinc, about 0.01 to about 10 percent by weight of a rare earth metal or a mixture of rare earth metals, the balance aluminum, and placing the anode into the aqueous solution with the ferrous metal.

* * * * *